US007976140B2

(12) United States Patent
Umeda

(10) Patent No.: US 7,976,140 B2
(45) Date of Patent: Jul. 12, 2011

(54) LIQUID DROPLET EJECTING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 575 days.

(21) Appl. No.: 12/056,219

(22) Filed: Mar. 26, 2008

(65) Prior Publication Data

US 2008/0238979 A1 Oct. 2, 2008

(30) Foreign Application Priority Data

Mar. 28, 2007 (JP) ..... 2007-084698

(51) Int. Cl.
*B41J 2/175* (2006.01)
*B41J 23/00* (2006.01)
*B41J 2/19* (2006.01)

(52) U.S. Cl. ..... 347/85; 347/37; 347/92

(58) Field of Classification Search ..... 347/6, 37, 347/84–86, 92, 94
See application file for complete search history.

(56) References Cited

U.S. PATENT DOCUMENTS 5,485,187 A * 1/1996 Okamura et al. ..... 347/85
6,145,971 A 11/2000 Baker et al.
6,409,322 B1 * 6/2002 Ishitsu et al. ..... 347/85
2001/0040610 A1 * 11/2001 Kurata et al. ..... 347/85
2005/0206691 A1 9/2005 Takata et al.
2006/0132554 A1 * 6/2006 Ota et al. ..... 347/85

FOREIGN PATENT DOCUMENTS

JP 2001-301200 A 10/2001
JP 2002-264358 A 9/2002
JP 2005271546 A 10/2005

OTHER PUBLICATIONS

Japan Patent Office, Notice of Reasons for Rejection for Japanese Patent Application No. 2007-084698 (counterpart to above-captioned patent application), mailed May 10, 2011.

* cited by examiner

*Primary Examiner* — Stephen D Meier
*Assistant Examiner* — Geoffrey Mruk
(74) *Attorney, Agent, or Firm* — Baker Botts L.L.P.

(57) ABSTRACT

A liquid droplet ejecting apparatus is provided. The liquid droplet ejecting apparatus includes: a liquid storage container for storing a liquid therein; a carriage configured to reciprocate; an ejecting head mounted on the carriage and configured to eject liquid droplets; a liquid tank which is mounted on the carriage and is connected to the ejecting head and which is connected to the liquid storage container via a flexible tube; an air supply and discharge unit configured to supply air to the liquid tank and discharge air from the liquid tank; and a pressure controller controls the air supply and discharge unit so as to reduce a pressure fluctuation in the internal pressure of the liquid tank generated due to an inertial force applied to a liquid in the tube when the carriage changes a moving direction thereof.

17 Claims, 6 Drawing Sheets

LIQUID DROPLET EJECTING APPARATUS

CROSS-REFERENCE TO RELATED APPLICATION

This application claims priority from Japanese Patent Application No, 2007-084698, filed on Mar. 28, 2007, the entire subject matter of which is incorporated herein by reference.

TECHNICAL FIELD

Aspects of the present invention relate to a liquid droplet ejecting apparatus configured to eject liquid droplets.

BACKGROUND

An inkjet printer as an example of a liquid droplet ejecting apparatus includes: an ink cartridge (liquid storage container) mounted on a main body frame; a carriage configured to reciprocate in one direction; an inkjet head (a droplet ejecting head) which is mounted on the carriage to eject droplets from a plurality of nozzles; a sub-tank (liquid tank) mounted on the carriage and connected to the ink cartridge via flexible tube. This inkjet printer prints desired images and the like by ejecting inks onto a recording medium from the plurality of nozzles of the inkjet head while the carriage reciprocates.

In the inkjet printer, when the carriage changes its moving direction, inertial force is applied to the ink in the tube connected to the sub-tank mounted on the carriage. Then, due to inertial force applied to the ink in the tube, the ink flow into the sub-tank from the tube, or the ink flow out of the sub-tank into the tube. Due to dynamic pressures of the ink, an internal pressure in the sub-tank fluctuates, and a back-pressure of the inkjet head further fluctuates, which results in an effect on the ejection characteristics from the nozzles.

JP-A-2005-271546 describes an inkjet printer for reducing such pressure fluctuation in a sub-tank. The inkjet printer includes a sub-tank to which a damper unit is provided. The damper unit has a flexible film for damper at a position facing inflow an opening into which an ink supplied from a tube is made to flow. This inkjet printer absorbs a dynamic pressure of the ink generated in the tube with the flexible films when the carriage changes its moving direction.

However, if a recording speed becomes high, it is difficult for the flexible film in JP-A-2005-271546 to sufficiently absorb the dynamic pressure of the ink generated in the tube since the dynamic pressure of the ink generated in the tube when the carriage changes its moving direction becomes high. That is, when an attempt is made to sufficiently absorb the dynamic pressure of the ink generated in the tube, a flexible film having extremely large area is required, and the sub-tank and the carriage on which the sub-tanks are mounted would become greater.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a liquid droplet ejecting apparatus capable of reducing a pressure fluctuation in a liquid tank generated due to a dynamic pressure of liquid in a tube when a carriage changes its moving direction.

According to an exemplary embodiment of the present invention, there is provided a liquid droplet ejecting apparatus comprising: a liquid storage container for storing a liquid therein; a carriage configured to reciprocate between a first end and a second end; an ejecting head mounted on the carriage and configured to eject liquid droplets; a liquid tank which is mounted on the carriage and is connected to the ejecting head and which is connected to the liquid storage container via a flexible tube; an air supply and discharge unit configured to supply air to the liquid tank and discharge air from the liquid tank; and a pressure controller configured to control an internal pressure of the liquid tank by controlling the air supply and discharge unit. The pressure controller controls the air supply and discharge unit so as to reduce a pressure fluctuation in the internal pressure of the liquid tank generated due to an inertial force applied to a liquid in the tube when the carriage changes a moving direction thereof.

According to another exemplary embodiment of the present invention, there is provided a liquid droplet ejecting apparatus comprising: a first liquid tank for storing a liquid therein; a second liquid tank connected to the first liquid tank via a tube and is configured to store a liquid supplied from the first liquid tank; an ejecting head configured to eject liquid droplet which is supplied from the second liquid tank; a carriage configured to reciprocate between a first end and a second end and mounted thereon the second liquid tank and the ejecting head; an air supply and discharge unit configured to supply air to the second liquid tank and discharge air from the second liquid tank; and a pressure controller configured to control the air supply and discharge unit to supply air to the second liquid tank and discharge air from the second liquid tank at least one time when the carriage changes a moving direction thereof.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Figure 1:
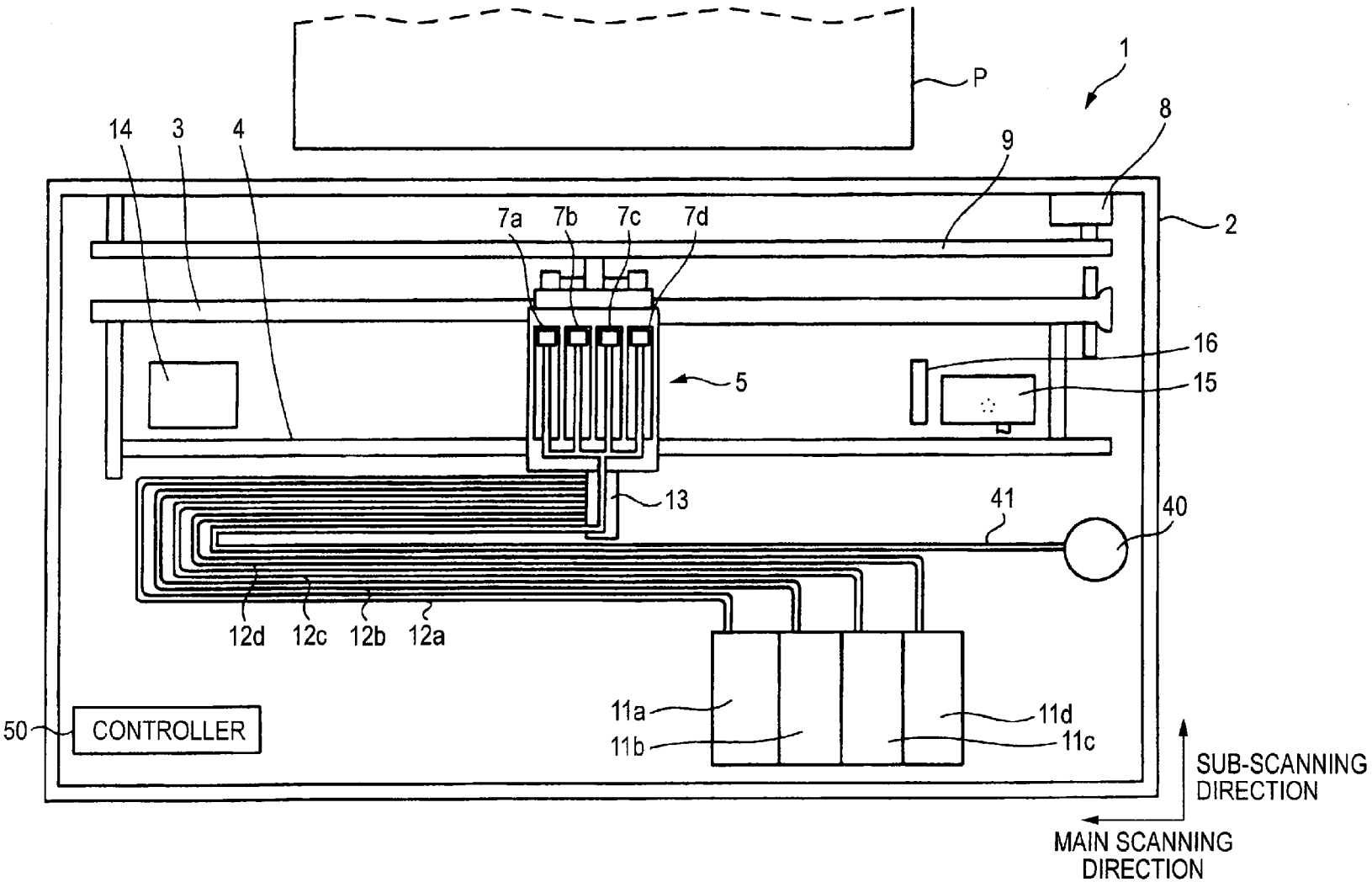
FIG. 1 is a plan view showing a schematic configuration of an inkjet printer according to an exemplary embodiment of the present invention.

Hereinafter, an exemplary embodiment of the present invention will be described in detail with reference to the accompanying drawings. The exemplary embodiment will be described in relation to an inkjet printer configured to eject inks onto a recording sheet to record desired characters, images and the like. However, the present inventive concept also applies to other liquid droplet ejecting apparatus configured to eject liquids. FIG. 1 is a plan view showing a schematic configuration of an inkjet printer according to the exemplary embodiment of the present invention. To describe hereinafter, in FIG. 1, a direction from the right to the left is referred to as a main scanning direction, and a direction from the bottom to the top is referred to as a sub-scanning direction.

As shown in FIG. 1, an inkjet printer 1 as an example of a liquid droplet ejecting apparatus includes two guide shafts 3 and 4 extending in the main scanning direction in a body case 2. A carriage 5 is installed to be reciprocable in the main scanning direction to these two guide shafts 3 and 4. Further, a carriage motor 8 is installed in the body case 2, and an endless belt 9 is wrapped onto a drive shaft of the carriage motor 8. A carriage 5 is coupled with the endless belt 9. As the carriage motor 8 drives the endless belt 9, the carriage 5 reciprocates in the main scanning direction between a left end (first end) and a right end (second end).

Four sub-tanks 7*a* to 7*d* as an exampled of liquid tanks are aligned in the main scanning direction and mounted on the carriage 5. A black ink, a yellow ink, a magenta ink, and a cyan ink supplied from ink cartridges 11*a* to 11*d* which will be described later are respectively stored in the sub-tanks 7*a* to 7*d*. An inkjet head 6 as an exampled of a liquid ejecting head includes flow paths which are connected to the respective sub-tanks 7*a* to 7*d* at the lower surfaces of the four sub-tanks 7*a* to 7*d* (refer to FIG. 2). Then, the sub-tanks 7*a* to 7*d* and the inkjet head 6 are mounted on the carriage 5. The inkjet head 6 has a plurality of nozzles (not shown) through which ink droplets are ejected onto a printing sheet P conveyed by a conveying mechanism 80 (refer to FIG. 3) under the carriage 5 to carry out printing. A tube joint 13 is provided to the carriage 5 at a downstream side of the sheet conveying direction (the lower side of FIG. 1) in the sub-scanning direction of the carriage 5.

The body case 2 includes the four ink cartridges 11*a*, 11*b*, 11*c*, and 11*d* as an example of a liquid storage container which supply respective color inks to the inkjet head 6. A black ink, a yellow ink, a magenta ink, and a cyan ink are respectively stored in the ink cartridges 11*a* to 11*d*. The inks stored in the ink cartridges 11*a* to 11*d* are supplied to the sub-tanks 7*a* to 7*d* via flexible ink tubes 12*a* to 12*d* and the tube joint 13. After the inks are temporally stored in the sub-tanks 7*a* to 7*d*, inks are further supplied to the inkjet head 6. The ink tubes 12*a* to 12*d* extend to the left in a state in which one connecting ends thereof are respectively connected to the sub-tanks 7*a* to 7*d* via the tube joint 13 from the left, and bent (turning portion) on the left end portion of the body case 2 to extend to the right. Then, the other connecting ends of the ink tubes 12*a* to 12*d* are connected to the ink cartridges 11*a* to 11*d* disposed on the right side of the body case 2. Even in a case in which the sub-tanks 7*a* to 7*d* reciprocate in the main scanning direction along with the carriage 5, the ink tubes 12*a* to 12*d* always hold the status in which the ink tubes 12*a* to 12*d* extend in the main scanning direction on the left side of the sub-tanks 7*a* to 7*d*. Additionally, the turning portion of each of the ink tubes 12*a* to 12*d* is located at a left side from the carriage 5 regardless of a position of the carriage 5.

Further, in the body case 2, an ink absorption member 14 configured to absorb inks ejected from the nozzles of the inkjet head 6 at the time of flushing is provided at one end side in a direction of movement of the carriage 5 (on the left side in FIG. 1). On the other hand, a purge mechanism 15 to absorb inks from the nozzles at the time of purging is provided at the other end side in the direction of movement of the carriage 5 (on the right side in FIG. 1), and a wiper 16 to wipe inks adhered to the nozzle faces is provided on the left side of the purge mechanism 15.

Moreover, in order to reduce pressure fluctuations in the sub-tanks 7*a* to 7*d* due to dynamic pressures of inks generated in the ink tubes 12*a* to 12*d*, the body case 2 includes a pump 40 serving as an air supply and discharge unit which is configured to supply and discharge air to and from the sub-tanks 7*a* to 7*d*. Here, a tube pump is used as an example of the pump 40. The pump 40 is connected to one end of a flexible air tube 41. The other end of the air tube 41 is divided into four, which are respectively connected to the four sub-tanks 7*a* to 7*d*. According to this configuration, the pump 40 supplies the same amount of air to the four sub-tanks 7*a* to 7*d*, respectively, or discharges the same amount of air from the four sub-tanks 7*a* to 7*d*, respectively.

Figure 2:
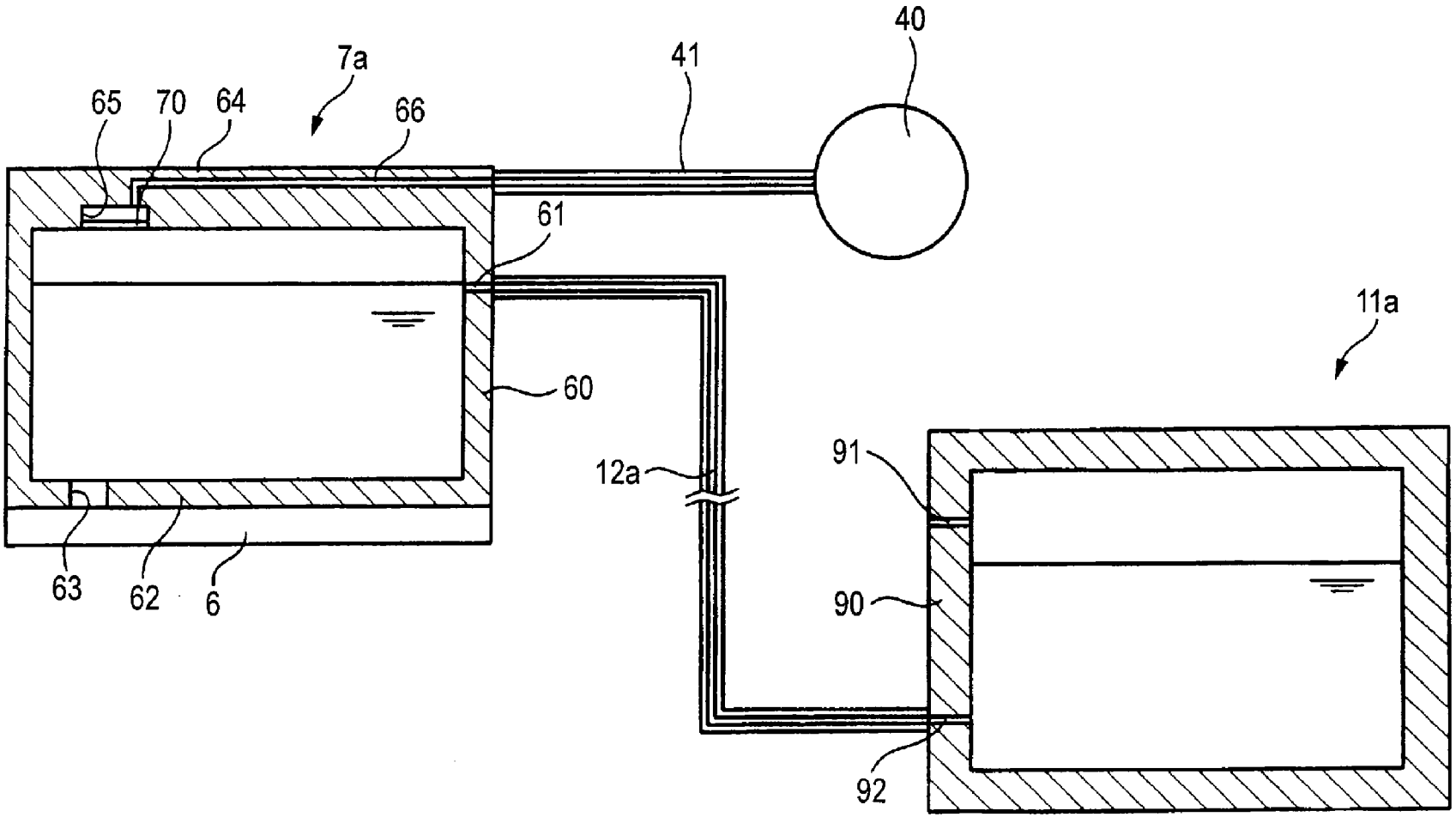
FIG. 2 is a plan view showing a schematic configuration of an ink cartridge, a sub-tank, and a tube pump according to the exemplary embodiment of the present invention.

The ink cartridges 11*a* to 11*d*, the sub-tanks 7*a* to 7*d*, and the pump 40 will be described in more detail. The respective ink cartridges 11*a* to 11*d* have similar configuration to each other, and the respective sub-tanks 7*a* to 7*d* have similar configuration to each other. Thus, the ink cartridge 11*a* and the sub-tank 7*a* will be described. FIG. 2 is a plan view showing a schematic configuration of the ink cartridge, the sub-tank, and the tube pump. It is noted that although the ink cartridge 11*a* and the sub-tank 7*a* are shown to have substantially same size in FIG. 2, the ink cartridges 11*a* to 11*d* are much larger than the sub-tanks 7*a* to 7*d*.

As shown in FIG. 2, the ink cartridge 11*a* has a substantially rectangular parallelepiped shape, and an ink is stored inside. The ink cartridge 11*a* is formed with an atmosphere communication part 91 horizontally passing through a side wall 90 thereof at an upper portion where the ink does not contact the side wall 90. The atmosphere communication part 90 connects an inside of the ink cartridge 11*a* to the atmosphere. Further, the ink cartridge 11*a* is formed with an ink supply part 92 horizontally passing through the side wall 90 thereof at a lower portion where the ink contacts the side wall 90. The ink supply part 92 is connected to the ink tube 12*a* to supply ink to the sub-tank 7*a*.

The sub-tank 7*a* has a substantially rectangular parallelepiped shape smaller than the ink cartridge 11*a*, and the ink supplied from the ink cartridge 11*a* via the ink tube 12*a* is stored in the sub-tank 7*a*. The ink cartridge 11*a* is formed with an ink input part 61 horizontally passing through a side wall 60 at an upper portion. The ink supply part 92 of the ink cartridge 11*a* and the ink input part 61 of the sub-tank 7*a* are connected to each another via the ink tube 12*a*. According to this configuration, the ink is supplied to the sub-tank 7*a* via the ink tube 12*a* from the ink cartridge 11*a*.

Further, the sub-tank 7*a* is formed with an opening 63 at a bottom wall 62 of the sub-tank 7*a*. Then, the inkjet head 6 is disposed at the lower side of the sub-tank 7*a* such that an ink input opening (not shown) of the inkjet head 6 is communicated with the opening 63. Then, the ink input from the opening 63 of the sub-tank 7*a* via the ink input opening of the inkjet head 6 is ejected from a nozzle via an ink flow path (not shown) formed in the inkjet head 6. Additionally, as the ink in the sub-tank 7*a* supplied to the inkjet head 6 decreases when the ink is ejected (consumed) from the nozzle, a pressure in the sub-tank 7*a* decrease. However, since the inside of the ink cartridge 11*a* is communicated with the atmosphere via the atmosphere communication part 91, ink is automatically filled into the sub-tank 7*a*.

The sub-tank 7*a* includes a concave portion 65 concave upward at the inner surface side of an upper wall 64 of the sub-tank 7*a* and an air flow path 66 horizontally passing through the upper wall 64 from the top surface of the concave portion 65, and the air flow path 66 is connected to the pump 40 via the air tube 41. An air-permeable membrane 70 is attached to the bottom surface of the concave portion 65 with adhesion or the like. The air-permeable membrane 70 is a membrane which allows air to pass through, but which blocks liquids such as ink and solid substances other than air to pass through. As the air-permeable membrane, for example, a porous fluorine resin film or the like may be used. According to this configuration, the air supplied from the pump 40 flows thorough the air tube 41 and the air path flow 66 and passes through the air-permeable membrane 70 and is supplied to the sub-tank 7*a*. Further, the air in the sub-tank 7*a* passes through the air-permeable membrane 70 is discharged via the air path flow 66 and the air tube 41 by the pump 40. At this time, due to the air-permeable membrane 70, it is possible to prevent the ink from being discharged along with the air when the air is discharged from the inside of the sub-tank 7*a*. Further, even when it ink and air exist in a state of mixing (in a state of foaming up) in the sub-tank 7*a*, it is possible to discharge only the air via the air-permeable membrane 70, and it is possible to reliably carry out air-liquid separation.

Figure 3:
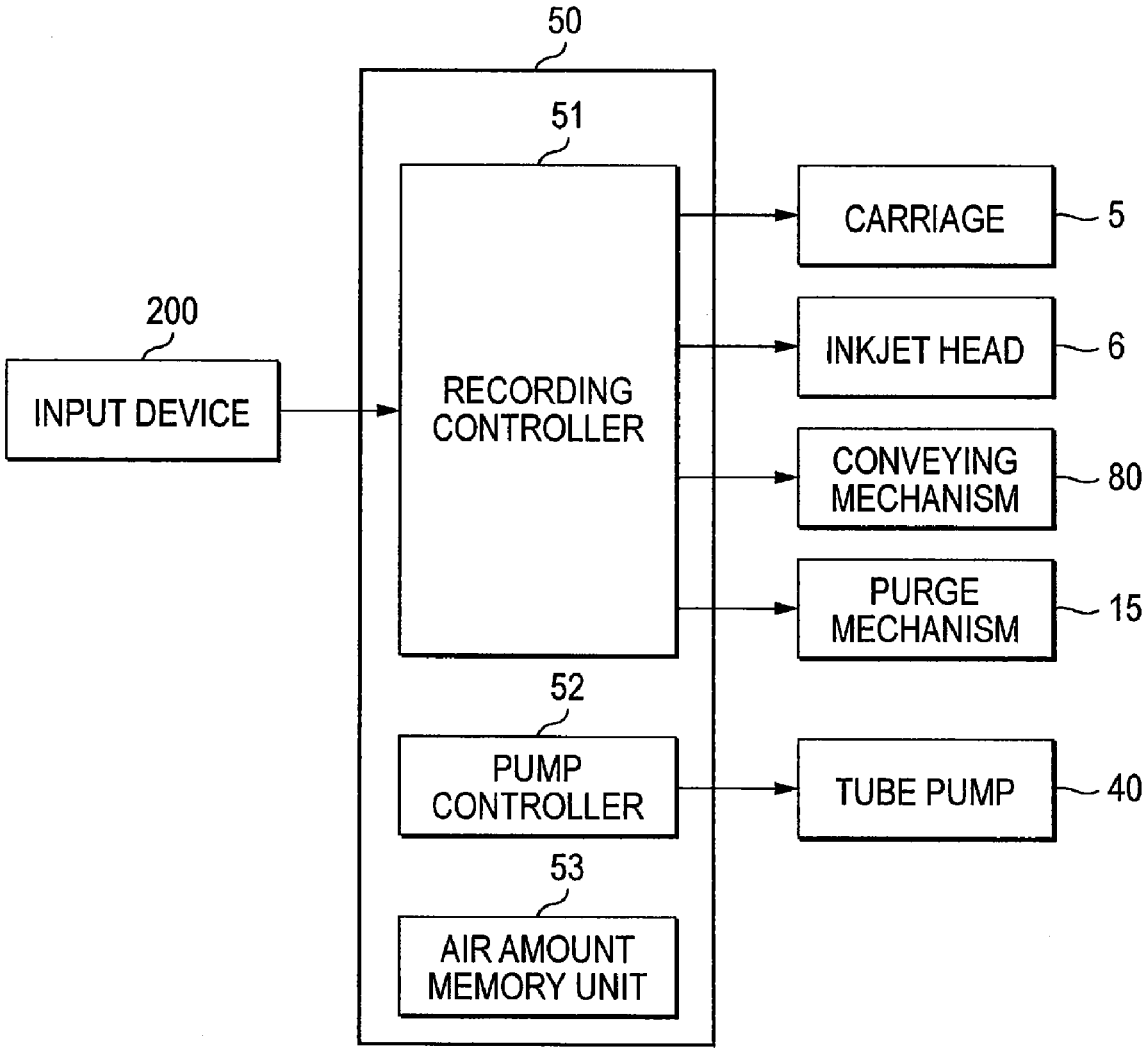
FIG. 3 is block diagram showing an electrical configuration of the inkjet printer.

Next, an electrical configuration of the inkjet printer 1 will be described with reference to FIG. 3. FIG. 3 is a block diagram showing the electrical configuration of the inkjet printer. As shown in FIG. 3, the inkjet printer 1 has a controller 50 configured to control the entire operations according to the exemplary embodiment of the present invention. The controller 50 includes a Central Processing Unit (CPU) which is a central processor, a Read Only Memory (ROM) which stores various programs, data, and the like for controlling the entire operations of the inkjet printer 1, a Random Access Memory (RAM) which temporarily stores data and the like processed in the CPU, an input and output interface, and the like are included.

The controller 50 has a recording controller 51, a pump controller 52 serving as a pressure controller, and an air amount memory unit 53.

When information such as recording data is inputted from an input device 200 such as a PC, the recording controller 51 conveys the recording sheet P in a sheet conveying direction by controlling the conveying mechanism 80. Further, the recording controller 51 determines an ejection mode, and controls the inkjet head 6 to move along with the carriage 5 at a moving speed according to the ejection mode and to eject ink with a droplet diameter according to the ejection mode onto the recording sheet P from the plurality of nozzles of the inkjet head 6. According to this configuration, characters, images, and the like corresponding to the recording data are recorded onto the recording sheet P. The ejection modes includes a several modes having different drop diameters ejected from the plurality of nozzles of the inkjet head 6 and different moving speeds of the carriage 5 in accordance with recording data. For example, in a text recording, diameters of droplets ejected from the plurality of nozzles are large, and a moving speed of the carriage 5 is fast. On the other hand, in a high-resolution recording, diameters of droplets ejected from the plurality of nozzles are small, and a moving speed of the carriage 5 is slow. The recording controller 51 performs purging by absorbing the inks from the nozzles of the inkjet head 6 by the purge mechanism 15 when a command to perform purging is inputted from the input device 200 such as a PC.

The pump controller 52 controls the pump 40 so as to supply or discharge a given amount of air according to a moving status of the carriage 5 and an ejection mode to or from the sub-tanks 7*a* to 7*d*.

The air amount memory unit 53 stores an amount of air to be supplied or discharged to or from the sub-tanks 7*a* to 7*d* by the pump 40 controlled by the pump controller 52, in advance in accordance with a moving status of the carriage 5 and an ejection mode.

Next, the effect due to an operation of air supply or discharge to or from the sub-tanks 7*a* to 7*d* by the pump 40 according to the exemplary embodiment will be described.

The carriage 5 repeats reciprocating so as to move to the left (first side) in FIG. 1 at a constant speed, and gradually slows down and stops in the vicinity of the left end of the guide shafts 3 and 4, and changes the moving direction to the right (second side). Then, the carriage 5 moves to the right at a constant speed, gradually slows down, stops in the vicinity of the right end of the guide shafts 3 and 4, and changes the moving direction to the left. The nozzles of the inkjet head 6 eject inks during the movement of the carriage 5 at a constant speed.

Here, when the carriage 5 gradually slows down and stops in the vicinity of the left end of the guide shafts 3 and 4, inertial force to the left is applied to the inks in the ink tubes 12*a* to 12*d*. Further, when the carriage 5 changes its moving direction to move to the right after the carriage 5 once stops in the vicinity of the left ends of the guide shafts 3 and 4, since the carriage 5 moves to the right with respect to the inks in the ink tubes 12*a* to 12*d* whose movement is stopped, inertial force to the left is applied to the inks in the ink tubes 12*a* to 12*d*. At this time, since the ink tubes 12*a* to 12*d* are connected to the sub-tanks 7*a* to 7*d* via the tube joint 13 from the left side in FIG. 1, the inks flow out of the sub-tanks 7*a* to 7*d* into the ink tubes 12*a* to 12*d*, and the pressures in the sub-tanks 7*a* to 7*d* decrease, respectively. If the pressures in the sub-tanks 7*a* to 7*d* decrease, ejecting pressures applied to the inks decrease in the ink flow paths in the inkjet head 6, which cause defective ejection and cause fluctuation in the ejection velocity.

Therefore, when the carriage 5 changes the moving direction to the right, in order not to decrease the pressures in the sub-tanks 7*a* to 7*d*, respectively, pressures are applied to the sub-tanks 7*a* to 7*d*, respectively, by supplying air to the sub-tanks 7*a* to 7*d* from the pump 40. According to this configuration, it is possible to reduce or prevent a decrease in pressures in the sub-tanks 7*a* to 7*d*.

Further, when the carriage 5 gradually slows down and once stops in the vicinity of the right ends of the guide shafts 3 and 4, inertial force to the right is applied to the inks in the ink tubes 12*a* to 12*d* due to the carriage 5 slowing down. Moreover, when the carriage 5 changes the direction to move to the left after the carriage 5 once stops in the vicinity of the right ends of the guide shafts 3 and 4, inertial force to the right is applied to the inks in the ink tubes 12*a* to 12*d* since the carriage 5 moves to the left with respect to the inks in the ink tubes 12*a* to 12*d* whose movement is stopped. At this time, since the ink tubes 12*a* to 12*d* are connected to the sub-tanks 7*a* to 7*d* via the tube joint 13 from the left side in FIG. 1, the inks flow from the ink tubes 12*a* to 12*d* into the sub-tanks 7*a* to 7*d*, and the pressures in the sub-tanks 7*a* to 7*d* increase, respectively. If the pressures in the sub-tanks 7*a* to 7*d* increase, ejecting pressures applied to the inks are increased in the ink flow paths in the inkjet head 6, which cause defective ejection and cause fluctuation in the ejection velocity.

Therefore, when the carriage 5 changes the moving direction to the left, in order not to increase the pressures in the sub-tanks 7*a* to 7*d*, the pressures in the sub-tanks 7*a* to 7*d* are decreased by discharging air from the sub-tanks 7*a* to 7*d* by the pump 40. According to this configuration, it is possible to reduce or prevent an increase in pressures in the sub-tanks 7*a* to 7*d*.

If an ejection mode differs, a recording speed, i.e., a reciprocating speed or a moving speed of the carriage 5 differs.

Therefore, the amount of inertial force applied to the inks in the ink tubes 12*a* to 12*d* when the carriage 5 changes the moving direction at the both ends of the guide shafts 3 and 4 varies, and the amount of pressure fluctuations in the sub-tanks 7*a* to 7*d* differs. Then, an amount of air to be supplied or discharged to or from the sub-tanks 7*a* to 7*d* by the pump 40 is changed in accordance with the ejection mode. Since inertial force applied to the inks in the ink tubes 12*a* to 12*d* in a high recording speed is larger than that in a low recording speed, and pressure fluctuations in the sub-tanks 7*a* to 7*d* become larger, an amount of air to be supplied or discharged to or from the sub-tanks 7*a* to 7*d* by the pump 40 is increased. According to this configuration, it is possible to more appropriately reduce or prevent pressure fluctuations in the sub-tanks 7*a* to 7*d*.

Figure 4:
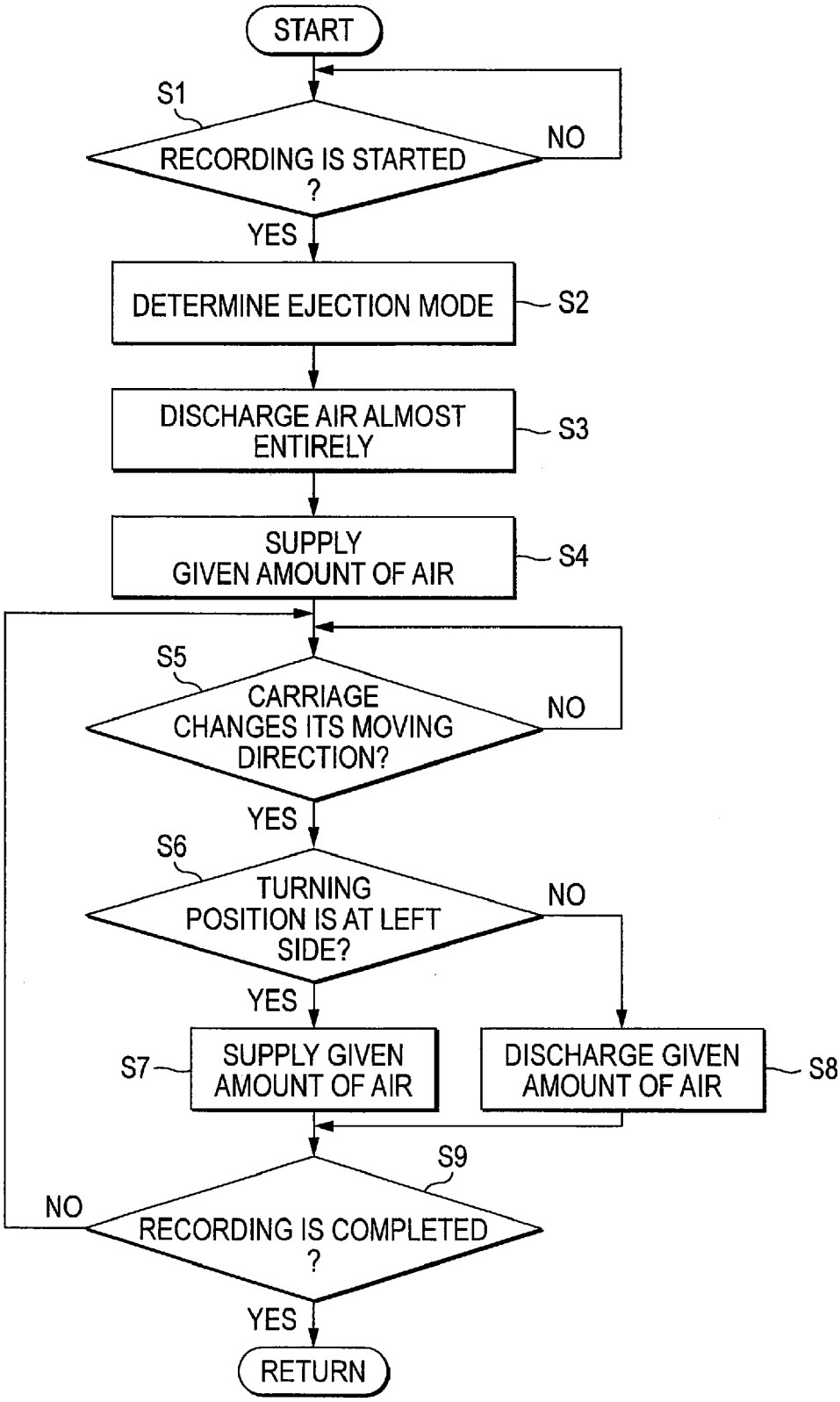
FIG. 4 is a flowchart showing a series of operations of the inkjet printer.

Next, a series of operations of the inkjet printer 1 according to the exemplary embodiment will be described with reference to FIG. 4. FIG. 4 is a flowchart showing the series of operations of the inkjet printer 1.

First, information such as recording data is inputted from the PC 200, and it is determined whether or not recording is to be started (S1). If a recording command is not inputted from the PC 200 (S1: No), this operation is held until a recording command is inputted. If a recording command is inputted from the PC 200, and the recording is started (S1: Yes), the recording controller 51 determines an ejection mode based on the recording command to carry out which one of the text recording (high-speed recording) and the high-resolution recording (low-speed recording) (S2).

Next, the air in the sub-tanks 7*a* to 7*d* is once discharged by the pump 40 almost entirely. That is, the inks in the sub-inks 7*a* to 7*d* contact the air-permeable membranes 70, no air is in the sub-inks 7*a* to 7*d*, and these are filled with only inks. Thereafter, only a given standard amount of air is supplied into the sub-tanks 7*a* to 7*d* from the pump 40 (S4).

Next, when the recording starts, the carriage 5 starts reciprocating in the main scanning direction by the recording controller 51. Then, the recording controller 51 determines whether or not the carriage 5 changes the moving direction when the carriage 5 is located in the vicinity of the both ends of the guide shafts 3 and 4 (S5). When the carriage 5 does not change the moving direction, and moves to the left or the right at a constant speed (S5: No), air is not supplied or discharged to or from the sub-tanks 7*a* to 7*d* by the pump 40, and the inks are ejected from the nozzles of the inkjet head 6. When the carriage 5 changes the moving direction (S5: Yes), the ejection of inks from the nozzles of the inkjet head 6 is stopped, and it is determined whether the turning position is at the left end (a connecting terminal side of the ink tubes 12*a* to 12*d*) (S6). When the turning position is at the left end (S6: Yes), the pump 40 supplies a given amount of air stored in the air amount memory unit 53 according to the turning position and the ejection mode from the sub-tanks 7*a* to 7*d* by the pump controller 52. Further, when the turning position is not at the left end, but at the right end (S6: No), the pump 40 discharges the given amount of air stored in the air amount memory unit 53 based on the turning position and the ejection mode into the sub-tanks 7*a* to 7*d* by the pump controller 52 (S8).

Then, it is determined whether or not the recording is completed (S9). When the recording is not completed (S9: No), the procedure returns to S5, air supply and discharge to or from the sub-tanks 7*a* to 7*d* is repeated by the pump 40 as the carriage 5 changes the moving direction. When the recording is completed (S9: Yes), the operations of the inkjet printer 1 are completed.

According to the above-described inkjet printer 1, the following advantages can be obtained. When the sub-tanks 7*a* to 7*d* connected to the ink cartridges 11*a* to 11*d* via the ink tubes 12*a* to 12*d* reciprocate along with the carriage 5, inertial force is applied to the inks in the ink tubes 12*a* to 12*d* when the carriage 5 changes the moving direction, and the pressures in the sub-tanks 7*a* to 7*d* fluctuate due to the inks flowing into the sub-tanks 7*a* to 7*d* or the inks flowing out from the sub-tanks 7*a* to 7*d* into the ink tubes 12*a* to 12*d*. Then, in the exemplary embodiment, when the carriage 5 changes the moving direction, the pump controller 52 supply air to the sub-tanks 7*a* to 7*d* or discharge air from the sub-tanks 7*a* to 7*d* by controlling the pump 40. According to this configuration, it is possible to reduce or prevent pressure fluctuations generated due to dynamic pressures of the inks in the ink tubes 12*a* to 12*d*. Further, it is possible to downsize the sub-tanks 7*a* to 7*d* and the carriage 5 as compared with a case in which dynamic pressures of inks are absorbed by the flexible films provided in the sub-tanks 7*a* to 7*d*.

Moreover, after the air in the sub-tanks 7*a* to 7*d* is once discharged almost entirely by the pump 40, only a given standard amount of air is supplied to the sub-tanks 7*a* to 7*d* from the pump 40 before the inks are ejected. Accordingly, a state in which a given amount of air required for absorbing pressure fluctuations generated due to dynamic pressures of the inks exist in the sub-tanks 7*a* to 7*d*. Therefore, it is possible to reliably reduce or prevent pressure fluctuations generated during an ejecting operation (while the carriage 5 moving).

Next, a modified exemplary embodiment applying various modifications to the above-described exemplary embodiment will be described. In the following, portions having the similar configuration of the above-described exemplary embodiment are denoted by the same reference numerals, and descriptions thereof will be omitted.

Figure 5:
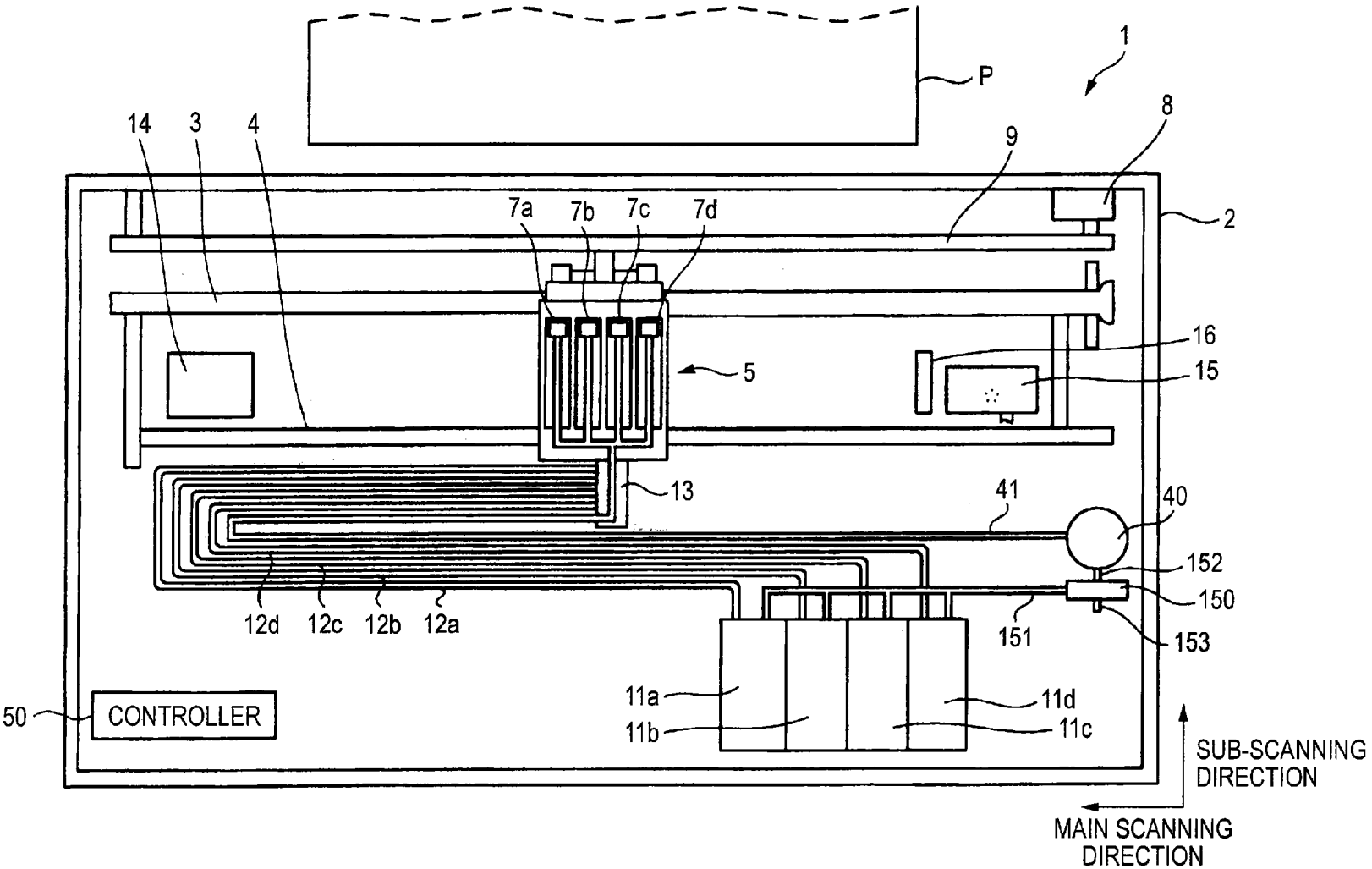
FIG. 5 is a plan view showing a schematic configuration of an inkjet printer according to a modified exemplary embodiment.
Figure 6:
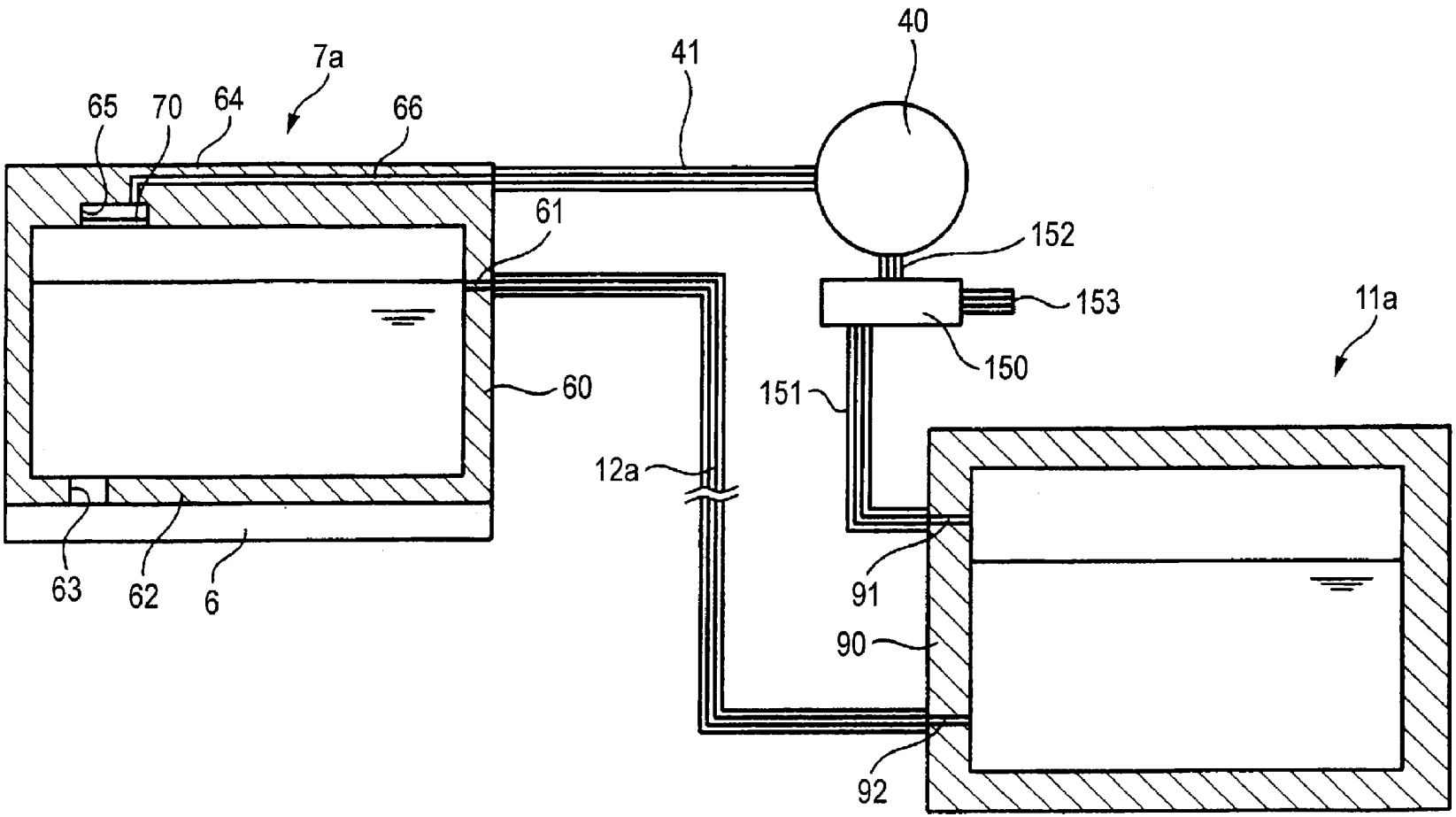
FIG. 6 is a plan view showing a schematic configuration of an ink cartridge, a sub-tank, and a tube pump according to the modified exemplary embodiment of the present invention.

As shown in FIG. 5 and FIG. 6, a switching valve 150 serving as a switching unit which switches communicating states of the atmosphere communication part 91 of the ink cartridges 11*a* to 11*d* may be provided in order to adjust the pressures in the ink cartridges 11*a* to 11*d* in the body case 2. The switching valve 150 switches communicating states in three directions. One direction among the three directions is connected to the pump 40 via an air tube 152. Another one direction is communicated with the atmosphere via an air tube 153. The other one direction is connected to the atmosphere communication part 91 of the ink cartridges 11*a* to 11*d* via an air tube 151. Then, the switching valve 150 is controlled by the controller 50 so as to switch a communicating state in which the pump 40 and the ink cartridges 11*a* to 11*d* are communicated with each other, and an atmosphere communicating state in which the pump 40 is communicated with the atmosphere.

When the carriage 5 changes the moving direction (the pump 40 supplies and discharges air to or from the sub-tanks 7*a* to 7*d*), the switching valve 150 makes the pump 40 and the ink cartridges 11*a* to 11*d* communicate with one another. And, the air supply or discharge which is the same as an operation of air supply or discharge in relation to the sub-tanks 7*a* to 7*d* is carried out in relation to the ink cartridges 11*a* to 11*d* as well by the pump 40. That is, when air is supplied to the sub-tanks 7*a* to 7*d* by the pump 40, the same amount of air is supplied to the ink cartridges 11*a* to 11*d* as well. Further, when air is discharged from the sub-tanks 7*a* to 7*d* by the pump 40, the same amount of air is discharged from the ink cartridges 11*a* to 11*d* as well. However, the present invention is not limited thereto. That is, the amount of air supplied or discharged to or from the ink cartridges 11*a* to 11*d* may be different from the amount of air supplied or discharge to or from the sub-tanks 7*a* to 7*d*.

When the supply and discharge of air in the sub-tanks 7*a* to 7*d* are carried out by the pump 40, a difference in pressures between the sub-tanks 7*a* to 7*d* and the ink cartridges 11*a* to lid varies, which generates the flow of ink between the both. Then, at the same time of the air supply or discharge in relation to the sub-tanks 7*a* to 7*d*, an operation of air supply or discharge is carried out in relation to the ink cartridges 11*a* to 11*d* as well. Therefore, it is possible to reduce or prevent a difference in pressures between the sub-tanks 7*a* to 7*d* and the ink cartridges 11*a* to 11*d* from varying. Then, it is possible to reduce or prevent the inks from flowing between the sub-tanks 7*a* to 7*d* and the ink cartridges 11*a* to 11*d* according to an internal pressure control of the sub-tanks 7*a* to 7*d*.

Further, while the carriage 5 does not change the moving direction and moves at a constant speed, and the inkjet head 6 ejects ink (the pump 40 does not supply or discharge air in relation to the sub-tanks 7*a* to 7*d*), the switching valve 150 makes the ink cartridges 11*a* to 11*d* communicate with the atmosphere. According to this configuration, when supply and discharge of air in relation to the sub-tanks 7*a* to 7*d* are not carried out, by making the ink cartridges 11*a* to 11*d* communicate with the atmosphere, it is possible to smoothly carry out supply of ink to the inkjet head 6 as usual. In stead of the switching valve, any of mechanisms or units capable of switching communicating states may be employed as the switching unit.

In the above-described exemplary embodiments, an operation of air supply or discharge in relation to the sub-tanks 7*a* to 7*d* is carried out via the air-permeable membranes 70 by the pump 70. However, when there is no risk that the inks are discharged by the pump 40 such as a case in which there is liquid and air not in a state of mixing (in a state of foaming up) in the liquid tanks, i.e., a case in which air-liquid separation is sufficiently carried out, the air-permeable membranes 70 may not be necessarily provided.

Further, in the above-described exemplary embodiments, is at the time of starting recording (before inks are ejected from the nozzles), after the air in the sub-tanks 7*a* to 7*d* is discharged almost entirely by the pump 40, only a given standard amount of air is supplied to the sub-tanks 7*a* to 7*d* by the pump 40. Provided that the amounts of air to be supplied and discharged to or from the sub-tanks 7*a* to 7*d* by the pump 40 are the same and the ejection mode has not changed, this operation may not be necessarily carried out.

Further, in the above-described exemplary embodiments, an amount of air to be supplied or discharged to or from the sub-tanks 7*a* to 7*d* by the pump 40 based on a turning position of the carriage 5 and an ejection mode is stored in advance in the air amount memory unit 53. However, the air amount memory unit 53 may not be provided. In this case, a sensor to detect pressures in the sub-tanks 7*a* to 7*d* may be provided, and the pump controller 52 may supply or discharge air to or from the sub-tanks 7*a* to 7*d* by controlling the pump 40 according to outputs from the sensor.

Additionally, in the above-described exemplary embodiments, an amount of air to be supplied or discharged to or from the sub-tanks 7*a* to 7*d* by the pump 40 is changed in accordance with a moving speed of the carriage 5. However, in a case in which a difference in pressure fluctuations in the sub-tanks 7*a* to 7*d* due to a moving speed of the carriage 5 being different is slight, it may be not necessary to change the amount of air to be supplied or discharged to or from the sub-tanks 7*a* to 7*d* by the pump 40 according to the moving speed of the carriage 5.

Further, in a case in which the extending direction of the ink tubes 12*a* to 12*d* is changed, it is not necessary to supply air by the pump 40 when the turning position of the carriage 5 is at the left end, and to discharge air by the pump 40 when the turning position of the carriage 5 is at the right end. For example, in a case in which the ink tubes 12*a* to 12*d* are bent in up and down direction (orthogonal to both the main scanning direction and the sub-scanning direction) when the turning position of the carriage 5 is at the right end, it is not necessary to discharge air to the sub-tanks 7*a* to 7*d* by the pump 40. This is the same as in the case in which the turning position of the carriage is at the left end. However, in a case in which it is possible to previously predict the behavior of a change in the extending direction of the ink tubes 12*a* to 12*d* when the carriage 5 is at the turning position of the left end or the turning position of the right end, a calculation may be made about pressure fluctuations in the sub-tanks 7*a* to 7*d* based on the predicted behavior, and supply or discharge of air by the pump 40 may be carried out so as to reduce or prevent the pressure fluctuation.

Additionally, apart from the inkjet printer, the present invention may be applied to various types of liquid droplet ejecting apparatuses for ejecting liquid droplet other than ink such as an apparatus for coating color liquids for production of color filters for liquid crystal displays.

The present invention provides illustrative, non-limiting embodiments as follows:

A liquid droplet ejecting apparatus comprises: a liquid storage container for storing a liquid therein; a carriage configured to reciprocate between a first end and a second end; an ejecting head mounted on the carriage and configured to eject liquid droplets; a liquid tank which is mounted on the carriage and is connected to the ejecting head and which is connected to the liquid storage container via a flexible tube; an air supply and discharge unit configured to supply air to the liquid tank and discharge air from the liquid tank; and a pressure controller configured to control an internal pressure of the liquid tank by controlling the air supply and discharge unit. The pressure controller controls the supply and discharge unit so as to reduce a pressure fluctuation in the internal pressure of the liquid tank generated due to an inertial force applied to a liquid in the tube when the carriage changes a moving direction thereof.

In the liquid droplet ejecting apparatus, when the liquid tank connected to the liquid storage container via the tubes reciprocate along with the carriage, inertial force is applied to the liquid in the tube when the carriage changes the moving direction, and pressures in the liquid tank fluctuate due to the ink flowing into the liquid tank from the tube or the inks flowing out of the liquid tank into the tube. However, according to the above configuration, it is possible to reduce or prevent the pressure fluctuation in the liquid tank due to dynamic pressure of liquid in the tube. Further, it is possible to make the liquid tank and the carriage on which the liquid tank are mounted smaller compared with a in which dynamic pressures of liquids are absorbed by the flexible films provided in the liquid tank.

Further, the liquid tank may be connected to the supply and discharge unit via an air-permeable membrane which allows air to pass therethrough and blocks a liquid to pass therethrough. According to this configuration, when air is discharged from the liquid tank, it is possible to reduce or prevent the liquid from being discharged along with the air. Further, even in a case in which liquid and air exist in a state of mixing (in a state of foaming up) in the liquid tank, it is possible to discharge only the air via the air-permeable membrane, and it is possible to reliably carry out air-liquid separation.

Moreover, the pressure controller may control the air supply and discharge unit to discharge air from the liquid tank almost entirely and supply a given amount of air to the liquid tank before the ejecting head starts ejecting liquid droplets. According to this configuration, before the droplet ejecting head performs an ejecting operation (before the carriage starts reciprocating), there is always a given amount of air required for absorbing the pressure fluctuation due to dynamic pressures of liquid in the liquid tank, and it is possible to reliably reduce or prevent pressure fluctuation generated during an ejecting operation (while the carriage is moving).

Additionally, the carriage may include a tube joint to which the tube is jointed. The tube may extend from the tube joint toward one of the first end and the second end regardless of a position of the carriage. The pressure controller may control the air supply and discharge unit to supply air to the liquid tank when the carriage change the moving direction from toward the one of the first end and the second end to toward the other of the first end and the second end. The pressure controller may control the air supply and discharge unit to discharge air from the liquid tank when the carriage change the moving direction from toward the other of the first end and the second end to toward the one of the first end and the second end. According to this configuration, it is possible for the pressure controller to reduce or prevent the pressure fluctuation in the liquid tank by making the air supply and discharge unit discharge air from the liquid tank when the pressures in the liquid tank is increased, and by making the air supply and discharge unit supply air into the liquid tank when the pressure in the liquid tank is decreased.

The tube may be non-rotatably connected to the tube joint of the carriage. According to this configuration, a direction to which the tubes extend from the liquid tank is always easily directed to the same direction.

Moreover, the liquid droplet ejecting apparatus may further comprise a speed controller configured to control a moving speed of the carriage. The pressure controller may change an amount of air to be supplied or discharged by the air supply and discharge unit according to the moving speed of the carriage. Since inertial force (dynamic pressure) to a liquid generated when the carriage changes the moving direction varies when a moving speed of the carriage differs due to droplet diameters and an ejecting speed difference, the amount of pressure fluctuation in the liquid tank as well differs. Then, according to the above configuration, it is possible to more appropriately reduce or prevent pressure fluctuation in the liquid tank. More specifically, when a moving speed of the carriage is high speed, and a speed is rapidly changed at the time of changing the moving direction, an amount of air to be supplied and discharged is increased since inertial force generated in the liquid in the tube, i.e., the pressure fluctuation in the liquid tank becomes high. On the other hand, when a moving speed of the carriage is low, an amount of air to be supplied and discharged is decreased.

Additionally, the air supply and discharge unit may be connected to both the liquid tank and the liquid storage container. The pressure controller may control an internal pressure of the liquid storage container by controlling the air supply and discharge unit at the same time of controlling the internal pressure of the liquid tank. When air supply or discharge in relation to the liquid tank is carried out by the air supply and discharge unit, a difference in pressures between the liquid tank and the liquid storage container is changed, which generates the flow of liquid between the both. However, according to this configuration, it is possible to reduce or prevent a difference in pressures between the liquid tank and the liquid storage container from varying, and it is possible to reduce or prevent the liquid from flowing between the liquid tanks and the liquid storage container according to an internal pressure control of the liquid tank.

Additionally, the liquid droplet ejecting apparatus may further comprise a switching unit provided between the liquid storage container and the air supply and discharge unit, the switching unit is configured to switch between a first state in which the liquid storage container communicates with the air supply and discharge unit, and a second state in which the liquid storage container communicates with atmosphere. When the air supply and discharge unit supplies or discharge air to or from the liquid tank, the switching unit switches to the first state. On the other hand, when the air supply and discharge unit does not supply or discharge air to or from the liquid tank, the switching unit switches to the second state.

According to this configuration, when air supply or discharge with respect to the liquid tanks is not carried out, it is possible to carry out supply of liquid to the head as usual by making the liquid storage container communicate with the atmosphere.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A liquid droplet ejecting apparatus comprising:

a liquid storage container for storing a liquid therein;

a carriage configured to reciprocate between a first end and a second end;

an ejecting head mounted on the carriage and configured to eject liquid droplets;

a liquid tank which is mounted on the carriage and is connected to the ejecting head and which is connected to the liquid storage container via a flexible tube;

an air supply and discharge unit configured to supply air to the liquid tank and discharge air from the liquid tank; and a pressure controller configured to control an internal pressure of the liquid tank by controlling the air supply and discharge unit, wherein the pressure controller controls the air supply and discharge unit so as to reduce a pressure fluctuation in the internal pressure of the liquid tank generated due to an inertial force applied to a liquid in the tube when the carriage changes a moving direction thereof, wherein the pressure controller controls the air supply and discharge unit to supply air to the liquid tank when the carriage changes the moving direction from toward the one of the first end and the second end to toward the other of the first end and the second end, and wherein the pressure controller controls the air supply and discharge unit to discharge air from the liquid tank when the carriage changes the moving direction from toward the other of the first end and the second end to toward the one of the first end and the second end.

2. The liquid droplet ejecting apparatus according to claim 1, wherein the liquid tank is connected to the air supply and discharge unit via an air-permeable membrane which allows air to pass therethrough and blocks a liquid to pass therethrough.

3. The liquid droplet ejecting apparatus according to claim 2, wherein the pressure controller controls the air supply and discharge unit to discharge air from the liquid tank almost entirely and supply a given amount of air to the liquid tank before the ejecting head starts ejecting liquid droplets.

4. The liquid droplet ejecting apparatus according to claim 1, wherein the carriage includes a tube joint to which the tube is jointed, and wherein the tube extends from the tube joint toward one of the first end and the second end regardless of a position of the carriage.

5. The liquid droplet ejecting apparatus according to claim 4, wherein the tube is non-rotatably connected to the tube joint of the carriage.

6. The liquid droplet ejecting apparatus according to claim 1, wherein the tube includes a turning portion between the liquid tank and the liquid storage container, and wherein the turning portion is located at a side of one of the first end and the second end from the carriage regardless of a position of the carriage.

7. The liquid droplet ejecting apparatus according to claim 6, wherein the tube is non-rotatably connected to the carriage.

8. The liquid droplet ejecting apparatus according to claim 1, further comprising a speed controller configured to control a moving speed of the carriage, wherein the pressure controller changes an amount of air to be supplied or discharged by the air supply and discharge unit according to the moving speed of the carriage.

9. The liquid droplet ejecting apparatus according to claim 8, wherein the pressure controller controls the air supply and discharge unit to supply and discharge a first amount of air when the moving speed of the carriage is a low speed, and wherein the pressure controller controls the air supply and discharge unit to supply and discharge a second amount of air larger than the first amount of air when the moving speed of the carriage is a fast speed faster than the low speed.

10. The liquid droplet ejecting apparatus according to claim 9, wherein the speed controller controls the moving speed of the carriage to be the low speed in a high resolution mode in which the ejecting head ejects liquid droplets at high resolution, and wherein the speed controller controls the moving speed of the carriage to be the high speed in a low resolution mode in which the ejecting head ejects liquid droplets at low resolution.

11. The liquid droplet ejecting apparatus according to claim 1, wherein the air supply and discharge unit is connected to both the liquid tank and the liquid storage container, and wherein the pressure controller controls an internal pressure of the liquid storage container by controlling the air supply and discharge unit at the same time of controlling the internal pressure of the liquid tank.

12. The liquid droplet ejecting apparatus according to claim 11, further comprising a switching unit provided between the liquid storage container and the air supply and discharge unit, the switching unit configured to switch between a first state in which the liquid storage container communicates with the air supply and discharge unit, and a second state in which the liquid storage container communicates with atmosphere, wherein, when the air supply and discharge unit supplies or discharge air to or from the liquid tank, the switching unit switches to the first state, and wherein, when the air supply and discharge unit does not supply or discharge air to or from the liquid tank, the switching unit switches to the second state.

13. The liquid droplet ejecting apparatus according to claim 11, the air supply and discharge unit supplies or discharge air to or from the liquid storage container and the liquid tank by substantially same amount.

14. The liquid droplet ejecting apparatus according to claim 1, further comprising a storage unit which stores an amount of air to be supplied or discharged to or from the liquid tank, wherein the pressure controller controls the internal pressure of the liquid tank with reference to the amount of air stored in the storage unit.

15. The liquid droplet ejecting apparatus according to claim 1, further comprising a pressure sensor configured to detect the internal pressure of the liquid tank, wherein the pressure controller controls the internal pressure of the liquid tank with reference to the internal pressure detected by the sensor.

16. A liquid droplet ejecting apparatus comprising:

a first liquid tank for storing a liquid therein;

a second liquid tank connected to the first liquid tank via a tube and is configured to store a liquid supplied from the first liquid tank;

an ejecting head configured to eject liquid droplet which is supplied from the second liquid tank;

a carriage configured to reciprocate between a first end and a second end and mounted thereon the second liquid tank and the ejecting head;

an air supply and discharge unit configured to supply air to the second liquid tank and discharge air from the second liquid tank; and a pressure controller configured to control the air supply and discharge unit to supply air to the second liquid tank and discharge air from the second liquid tank at least one time when the carriage changes a moving direction thereof, wherein the pressure controller controls the air supply and discharge unit to supply air to the liquid tank when the carriage changes the moving direction from toward the one of the first end and the second end to toward the other of the first end and the second end, and wherein the pressure controller controls the air supply and discharge unit to discharge air from the liquid tank when the carriage changes the moving direction from toward the other of the first end and the second end to toward the one of the first end and the second end.

17. The liquid droplet ejecting apparatus according to claim 16, wherein an order of supplying air and discharging air by the air supply and discharge unit is switched between a case where the carriage changes the moving direction from toward the first end to toward the second end and a case where the carriage changes the moving direction from toward the second end to toward the first end.

* * * * *